US011976645B2

(12) United States Patent
Dombrock

(10) Patent No.: US 11,976,645 B2
(45) Date of Patent: May 7, 2024

(54) CABINET MOUNTED AIR COMPRESSOR WITH NEGATIVE CABINET PRESSURE

(71) Applicant: Kasco Marine, Inc., Prescott, WI (US)

(72) Inventor: Todd Dombrock, Prescott, WI (US)

(73) Assignee: Kasco Marine, Inc., Prescott, WI (US)

( * ) Notice: Subject to any disclaimer, the term of this patent is extended or adjusted under 35 U.S.C. 154(b) by 12 days.

(21) Appl. No.: 17/588,776

(22) Filed: Jan. 31, 2022

(65) Prior Publication Data

US 2022/0243713 A1 Aug. 4, 2022

Related U.S. Application Data

(60) Provisional application No. 63/145,626, filed on Feb. 4, 2021.

(51) Int. Cl.

| | |
|---|---|
| ***F04B 39/06*** | (2006.01) |
| ***F04B 39/12*** | (2006.01) |
| ***F04B 39/16*** | (2006.01) |
| ***F04B 41/06*** | (2006.01) |
| ***F04B 53/06*** | (2006.01) |

(Continued)

(52) U.S. Cl.

CPC ..... *F04B 39/066* (2013.01); *F04B 39/121* (2013.01); *F04B 39/123* (2013.01); *F04B 39/16* (2013.01); *F04B 41/06* (2013.01); *F04B 53/06* (2013.01); *F04B 53/08* (2013.01); *F04B 53/20* (2013.01)

(58) Field of Classification Search

CPC .... F04B 39/066; F04B 39/121; F04B 39/123; F04B 39/16; F04B 41/06; F04B 53/06; F04B 53/08; F04B 53/20; C02F 7/00; F01P 2001/005; F04D 29/5806; F24F 7/08

See application file for complete search history.

(56) References Cited

U.S. PATENT DOCUMENTS 4,378,982 A * 4/1983 McCombs ..... B01D 53/0407 96/117
9,789,447 B1 * 10/2017 Cordes ..... F04B 39/066

(Continued)

FOREIGN PATENT DOCUMENTS

EP 0547254 * 6/1993 ..... C02F 3/20

OTHER PUBLICATIONS

EP0547254 translation (Year: 2023).*

*Primary Examiner* — Charles G Freay
*Assistant Examiner* — David N Brandt
(74) *Attorney, Agent, or Firm* — MERCHANT & GOULD

(57) ABSTRACT

Air compressor systems that are configured to output compressed air. Each system includes a cabinet and at least one air compressor mounted at least partially in the cabinet. The air compressor includes a drive motor with a cooling air inlet through which cooling air can be input for cooling the drive motor. The cooling air inlet is directly fluidly connected to a cooling air opening of the cabinet so that the cooling air for the drive motor is drawn into the drive motor directly from the ambient environment instead of being drawn in from the interior space of the cabinet. In addition, the system includes an exhaust fan on the cabinet that vents the interior space of the cabinet to the ambient environment. During operation of the air compressor, a negative cabinet pressure is created in the interior space where the pressure is less than ambient pressure.

18 Claims, 9 Drawing Sheets

(51) Int. Cl.
*F04B 53/08* (2006.01)
*F04B 53/20* (2006.01)

(56) References Cited

U.S. PATENT DOCUMENTS

2014/0314586 A1* 10/2014 Kanaizumi ..... F04C 18/0207
417/362
2020/0324260 A1* 10/2020 Li ..... B01F 23/231151
2021/0340043 A1 11/2021 Dombrock et al.

* cited by examiner

CABINET MOUNTED AIR COMPRESSOR WITH NEGATIVE CABINET PRESSURE

FIELD

This technical disclosure relates to an air compressor system that is used to generate compressed air that can be used in any application that requires compressed air.

BACKGROUND

Compressed air is used in a number of applications. The compressed air is generated by an air compressor. In some applications, the air compressor is disposed within a cabinet which helps to protect the air compressor from the surrounding environment. A cabinet mounted air compressor that is used in a liquid aeration system is available from Kasco Marine of Prescott, Wisconsin.

SUMMARY

Air compressor systems are described herein that are configured to output compressed air. Each system includes a cabinet and at least one air compressor mounted at least partially or entirely in the cabinet. The air compressor includes a drive motor with at least one cooling air inlet through which cooling air can be input for cooling the drive motor. The at least one cooling air inlet is directly fluidly connected to a cooling air opening of the cabinet so that the cooling air for the drive motor is drawn into the drive motor directly from the ambient environment instead of being drawn in from the interior space of the cabinet. In addition, the system includes an exhaust fan on the cabinet that vents the interior space of the cabinet to the ambient environment. The system is configured such that during operation of the air compressor in generating compressed air, a negative cabinet pressure is created in the interior space of the cabinet where the pressure in the interior space of the cabinet is less than ambient pressure. The negative cabinet pressure helps the fan associated with the at least one cooling air inlet to run more efficiently.

In one embodiment, an air compressor system described herein can include a cabinet having a plurality of walls defining an interior space, with a first one of the walls having a cooling air opening that extends between the interior space and ambient environment. In addition, at least one air compressor is disposed partially or entirely within the interior space. The air compressor includes a head section and a drive motor section, with the head section having an air intake that receives air to be compressed and a compressed air exhaust through which compressed air is discharged. The drive motor section includes a drive motor and at least one cooling air inlet with a fan for drawing cooling air into the at least one cooling air inlet for cooling the drive motor. The at least one cooling air inlet is directly fluidly connected to the cooling air opening whereby the cooling air for the drive motor is drawn into the at least one cooling air inlet from the ambient environment. In addition, an exhaust fan is mounted on the cabinet and is in communication with the interior space, with the exhaust fan venting the interior space of the cabinet to the ambient environment.

In another embodiment, an air compressor system described herein can include a cabinet having a plurality of walls defining an interior space, with a first one of the walls having a cooling air opening extending therethrough in fluid communication with ambient environment. In addition, at least one air compressor is disposed partially or entirely within the interior space. The air compressor includes a head section and a drive motor section, with the head section having an air intake that receives air to be compressed and a compressed air exhaust through which compressed air is discharged. The drive motor section includes a drive motor and at least one cooling air inlet with a fan for drawing cooling air into the at least one cooling air inlet for cooling the drive motor. In addition, an exhaust fan is mounted on the cabinet and is in communication with the interior space with the exhaust fan venting the interior space of the cabinet to the ambient environment wherein during operation of the at least one air compressor the interior space of the cabinet has a negative pressure.

In still another embodiment, an air compressor system described herein can include a cabinet having a plurality of walls defining an interior space, with a first one of the walls having a cooling air opening extending therethrough in fluid communication with ambient environment. In addition, at least one air compressor is disposed partially or entirely within the interior space. The air compressor includes an air compression section and a drive motor section, with the drive motor section including a drive motor and at least one cooling air inlet with a fan for drawing cooling air into the at least one cooling air inlet for cooling the drive motor. The at least one cooling air inlet is directly fluidly connected to the cooling air opening whereby the cooling air for the drive motor is drawn into the at least one cooling air inlet from the ambient environment. In addition, an exhaust fan is mounted on the cabinet and is in communication with the interior space so that the exhaust fan vents the interior space of the cabinet to the ambient environment, wherein during operation of the at least one air compressor the interior space of the cabinet has a negative pressure.

The air compressor systems described herein can be used to supply compressed air to any system needing compressed air. In one example embodiment, the air compressor systems described herein can be used in a liquid aeration system to supply compressed air to a diffuser of the liquid aeration system.

DRAWINGS

DETAILED DESCRIPTION

Air compressor systems are described herein that include at least one air compressor mounted partially or entirely inside a cabinet. The systems are configured such that cooling air for cooling a drive motor of the air compressor is drawn in from the ambient environment instead of being drawn from the interior of the cabinet. In addition, an exhaust fan is mounted on the cabinet to vent the interior space of the cabinet to the ambient environment whereby during operation of the air compressor the interior of the cabinet is at negative pressure (i.e. the pressure is less than ambient pressure) or equal to ambient pressure.

Figure 1:
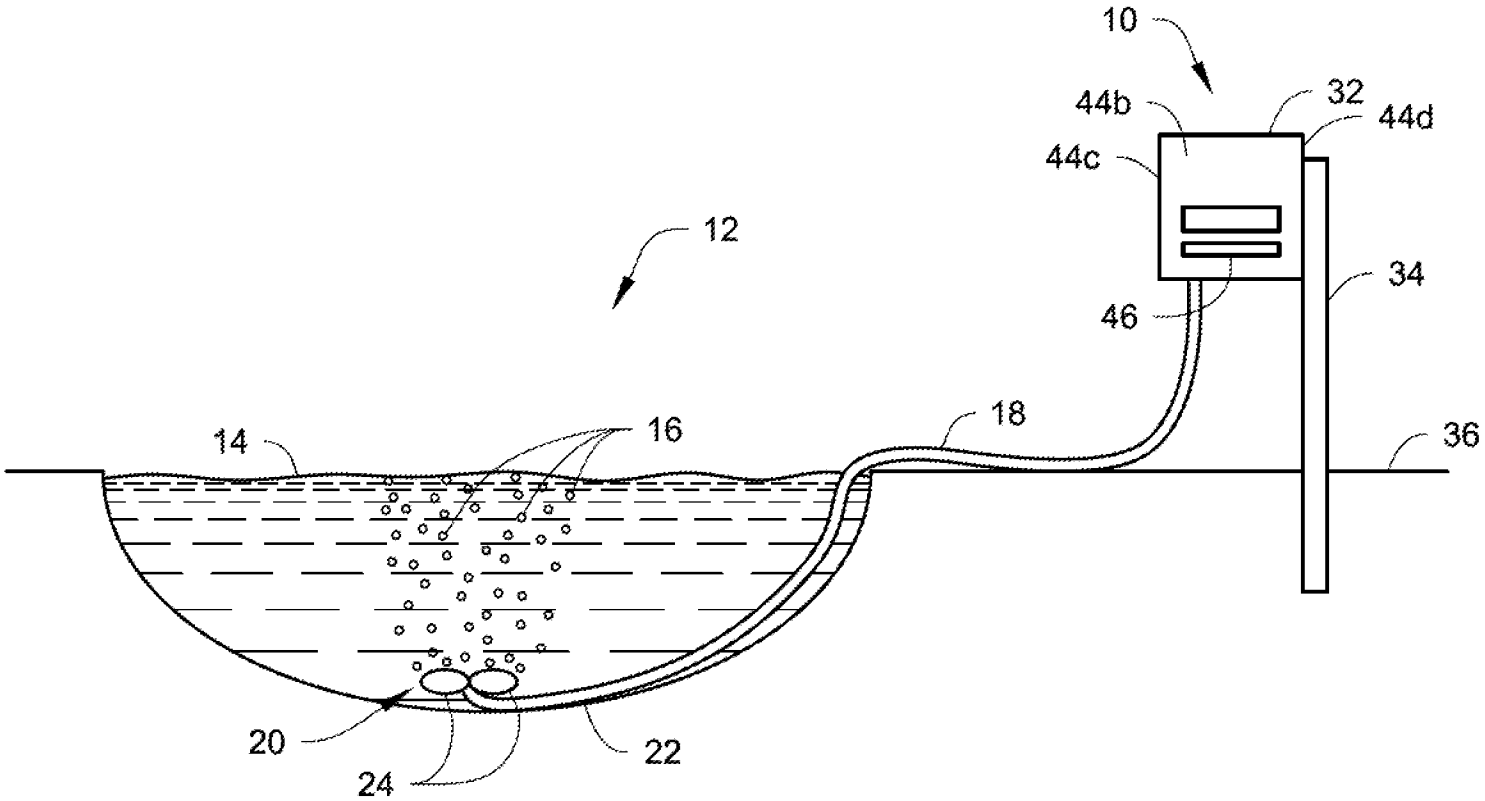
FIG. 1 is a schematic depiction of one embodiment of an air compressor system described herein used in an example application of a liquid aeration system.

FIG. 1 is a schematic depiction of an air compressor system 10 described herein used in an example application of a liquid aeration system 12 for aerating a body of water 14. The liquid aeration system 12 forms air bubbles 16 in the water that rise through the water and aerate the body of water 14. The upward movement of the air bubbles 16 also causes water to flow upward to prevent freezing of the water within the vicinity of the aeration system 12.

The liquid aeration system 12 includes a diffuser 20 that is connected to and receives compressed air from the air compressor system 10 via an air supply line 18. The diffuser 20 is located in the water. For example, the diffuser 20 can be configured to sit on the bottom 22 of the body of water 14. The compressed air flows from the air compression system 10 to the diffuser 20 and the diffuser 20 releases the air bubbles 16 into the water. For example, the compressed air is discharged through one or more porous surface(s) 24 of the diffuser 20 and is distributed into the water in the form of the air bubbles 16.

The body of water 14 can be any body of water, natural or man-made, that one may wish to aerate and prevent freezing of the water including, but not limited to, a pond, a lake, a river, and the like. The water in the body of water may be fresh water, salt water, potable water, brackish water, chemically treated water, or any other type of water that is subject to freezing. In other embodiments, the liquid aeration system 12 can be configured to aerate bodies of liquid other than water.

The air compressor system 10 is located outside of but near the body of water 14. For example, the air compressor system 10 in FIG. 1 is depicted as being located on the shore adjacent to the body of the water 14. As described in further detail below, the air compressor system 10 includes a cabinet 32 and at least one air compressor (not visible in FIG. 1) mounted in and disposed entirely inside the cabinet 32. The cabinet 32 is depicted as being mounted to a post 34 such that the cabinet 32 and the components therein are elevated above the ground 36. However, in other embodiments, the cabinet 32 may be configured to sit on the ground 36 or be supported on a pad, such as a concrete or composite pad, on the ground 36. The cabinet 32 can be located at any location on the shore or even supported above the water in the body of water 14.

Figure 2:
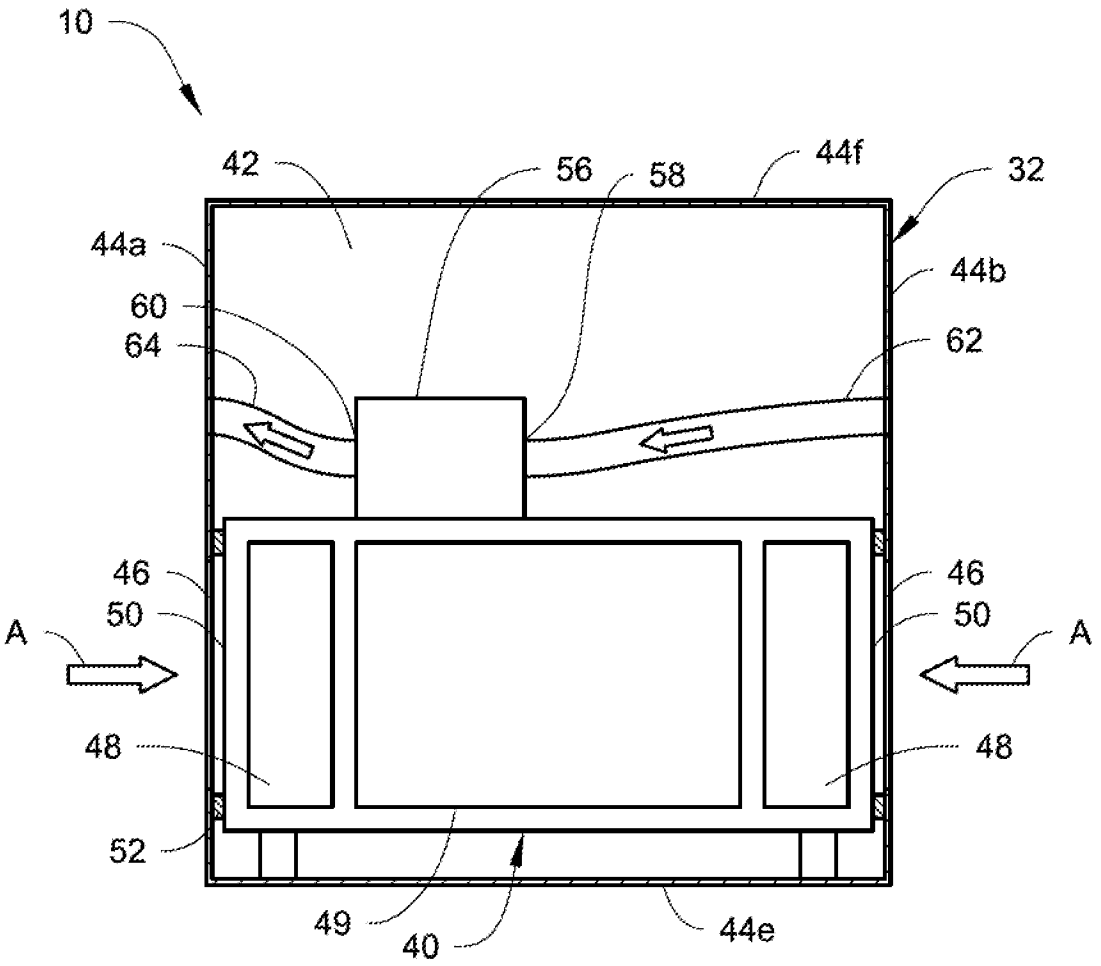
FIG. 2 is a schematic side view of the air compressor system showing an interior of a cabinet with a schematic depiction of an air compressor mounted in the cabinet.
Figure 7:
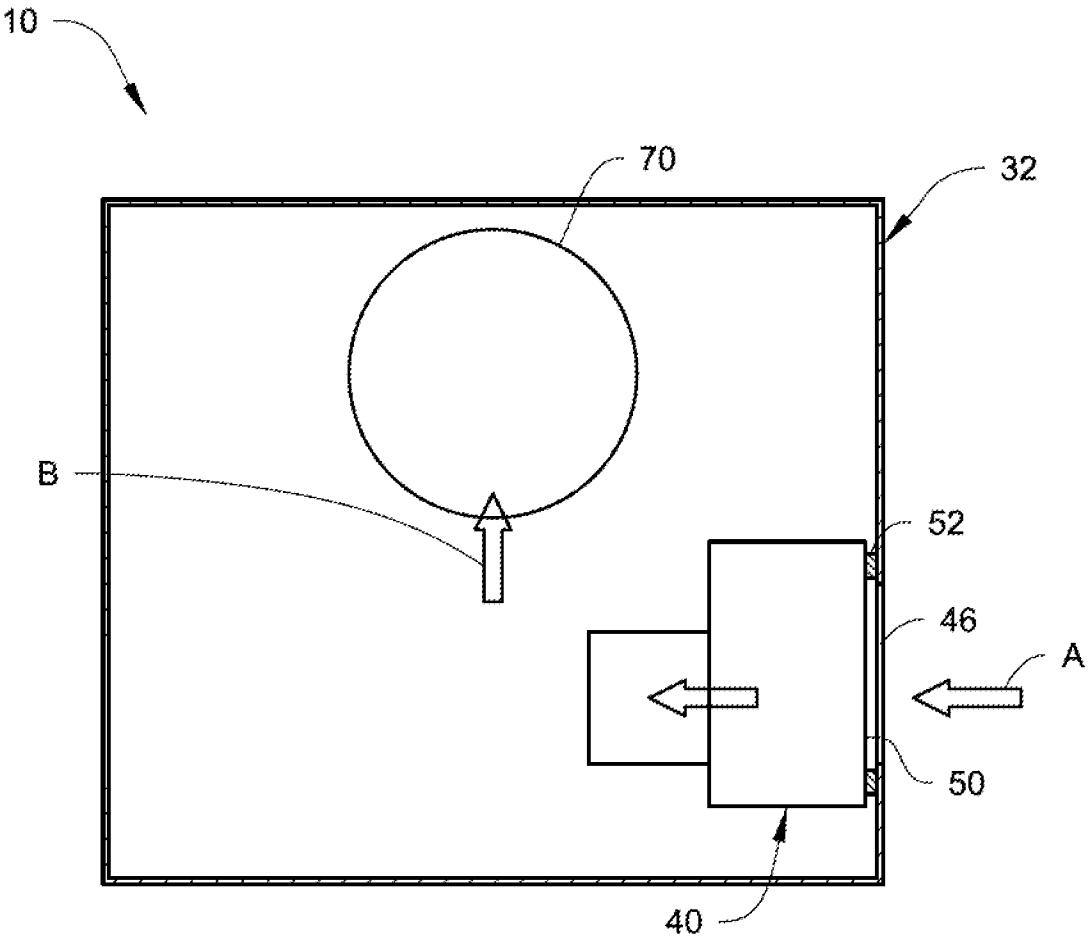
FIG. 7 is a schematic depiction of another embodiment using a single ended air compressor.

With reference to FIG. 2, a schematic side view of the air compressor system 10 is illustrated. In general, the system 10 incudes the cabinet 32 and an air compressor 40 with a drive motor section and a head section. A non-limiting example of an air compressor that can be used is a Teich-Aire™ Rocking Piston Compressor available from Kasco Marine, Inc. of Prescott, Wisconsin. The cabinet 32 has a plurality of walls defining an interior space 42. The walls include side walls 44*a-d* (see FIGS. 1 and 2), a bottom wall 44*e* and a top wall 44*f* that define the interior space 42. At least one of the walls 44*a-d*, 44*e*, 44*f* has at least one cooling air opening 46 (see FIG. 1) that extends between the interior space 42 and ambient environment. The cooling air opening 46 allows cooling air from the ambient environment to be pulled into the cabinet 32 by one or more cooling fans 48 associated with a drive motor 49 of the compressor 40 as indicated by the arrows A for cooling the drive motor 49 of the air compressor 40. FIG. 2 depicts the air compressor 40 as being a double ended compressor with a pair of the cooling fans 48 at opposite ends of the drive motor 49, each of which draws in cooling air through a cooling air inlet 50 for cooling the drive motor 49, using cooling air that is drawn through one of the cooling air openings 46 formed in each of the side walls 44*a*, 44*b*. However, as depicted in FIG. 7, the compressor 40 can be a single ended compressor with a single one of the cooling fans that draws in cooling air through a single cooling air inlet 50 for cooling the drive motor.

With continued reference to FIG. 2, the at least one cooling air inlet 50 is directly fluidly connected to the cooling air opening 46 whereby all of the cooling air, or substantially all of the cooling air, for the compressor drive motor 49 is drawn into the at least one cooling air inlet 50 from the ambient environment. Preferably no cooling air, or minimal cooling air, is drawn into the cooling air inlet(s) 50 from the interior space 42. To achieve this, the cooling air inlet 50 is directly fluidly connected to the cooling air opening 46 whereby the cooling air for the drive motor 49 is drawn into the cooling air inlet 50 from the ambient environment.

Figure 3:
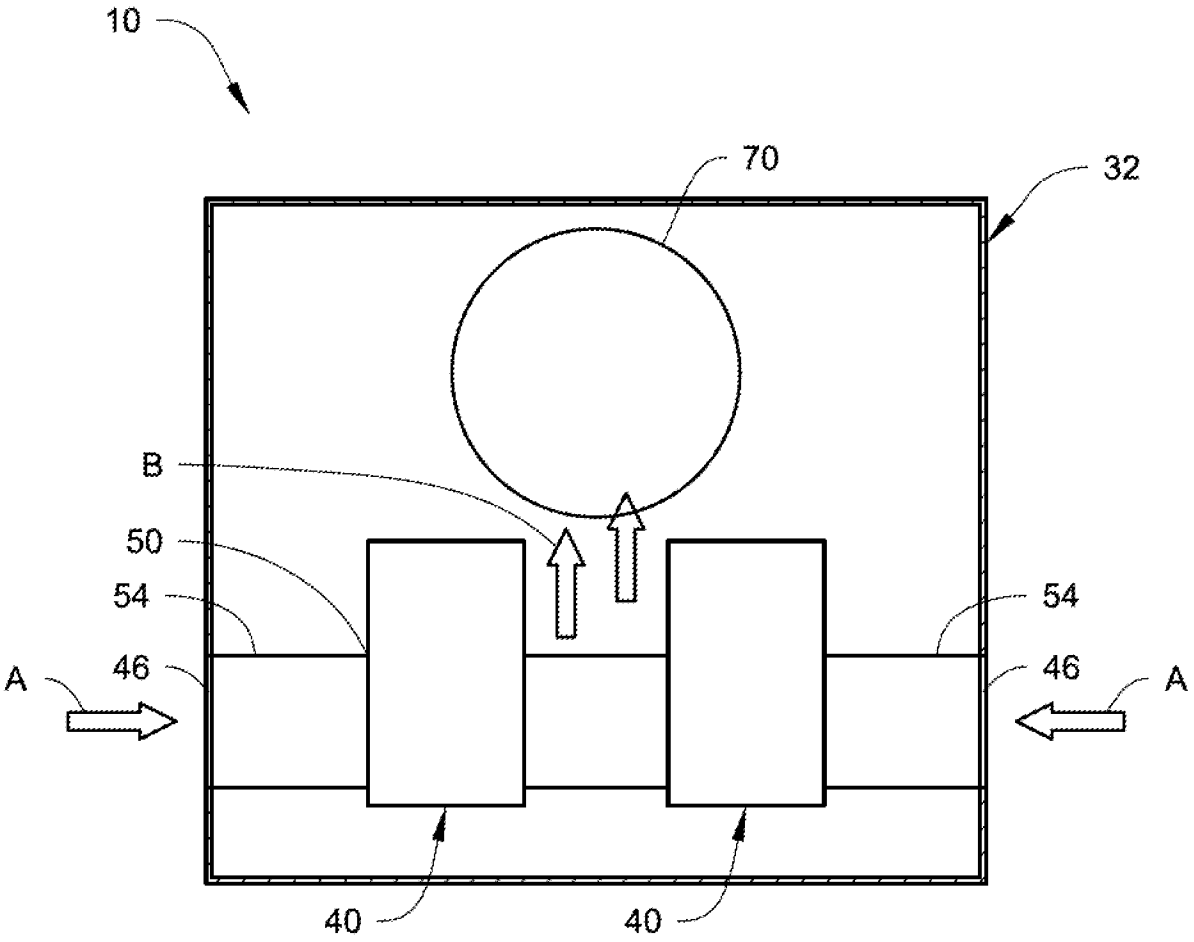
FIG. 3 illustrates another embodiment of the cabinet and air compressor.

Any technique for achieving the direct fluid connection between the cooling air inlet 50 and the cooling air opening 46 can be utilized. For example, as depicted at the right side of the compressor 40 in FIG. 2, the right end of the compressor 40 can abut against (i.e. be in direct physical engagement with) the side wall 44*b* at the location of the cooling air opening 46. The direct physical engagement with the side wall 44*b* ensures that the cooling air is drawn into the cooling air inlet 50 directly from the ambient environment through the cooling air opening 46. In another embodiment, as depicted at the left side of the compressor 40 in FIG. 2, the left end of the air compressor 40 is slightly spaced from the side wall 44*a* and a gasket 52 can be disposed between the left end of the compressor 40 and the side wall 44*a* at the location of and surrounding the cooling air opening 46. The gasket 52 effectively forms a sealed conduit for the cooling air from the cooling air opening 46 to the cooling air inlet 50. FIG. 3 illustrates another embodiment where the end of the air compressor 40 is spaced a relatively large distance from the side wall (compared to FIG. 2) and a fluid conduit 54 or snorkel extends from the cooling air opening 46 to the cooling air inlet 50 to direct the cooling air into the cooling air inlet 50. In still another embodiment, the portion of the compressor 40 containing the cooling air inlet 50 may partially extend through a side wall of the cabinet 32 to draw in cooling air, or the portion of the compressor 40 containing the cooling air inlet 50 may completely extend through a side wall of the cabinet 32 and can even project slightly from the side wall. Or the fluid conduit 54 in FIG. 3 can extend into or through the side wall. Many other configurations are possible as long as the cooling air is drawn in substantially from the ambient environment.

Figure 8:
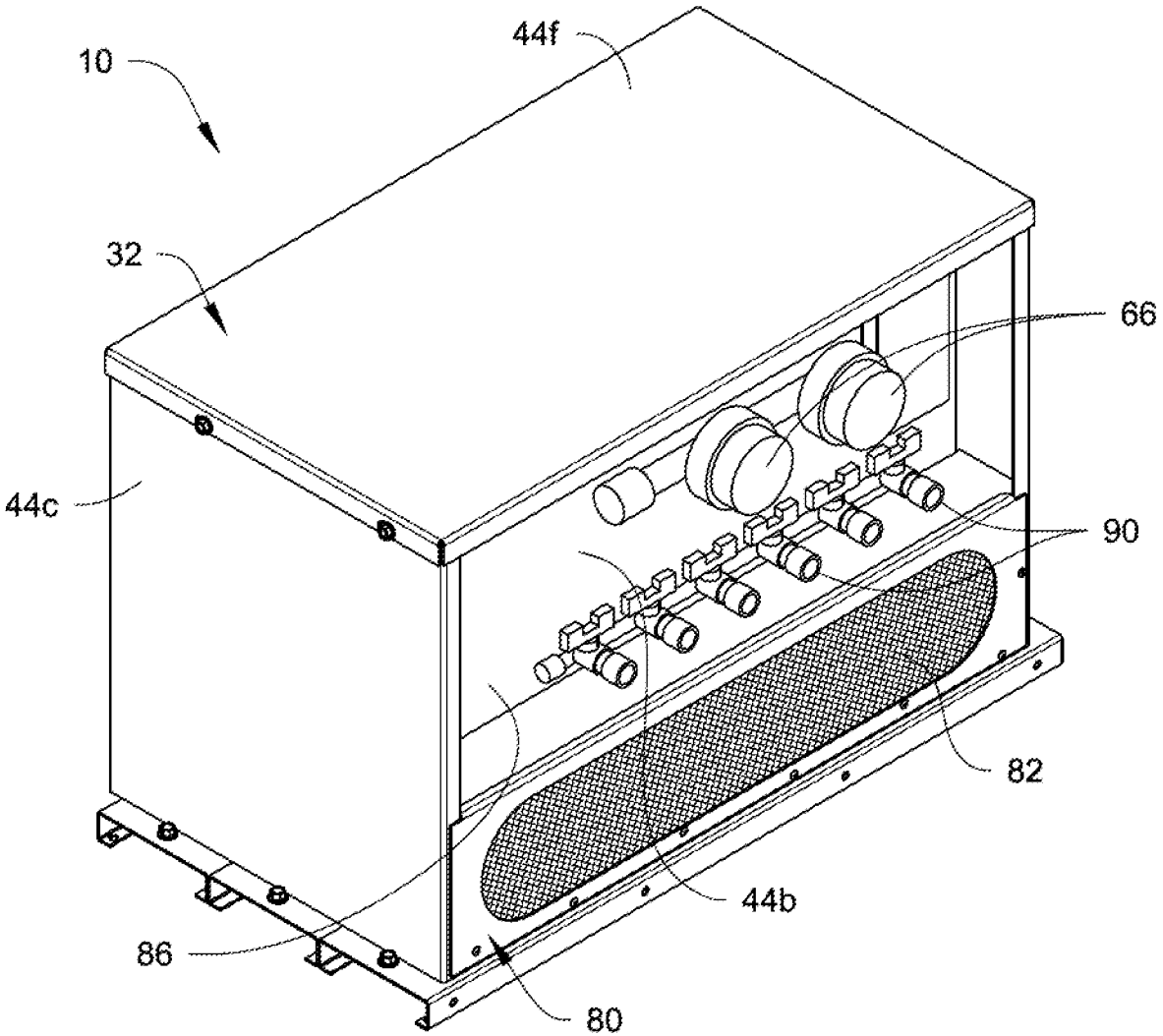
FIG. 8 is a perspective view of an embodiment of a cabinet depicting an example of one side of the cabinet.
Figure 10:
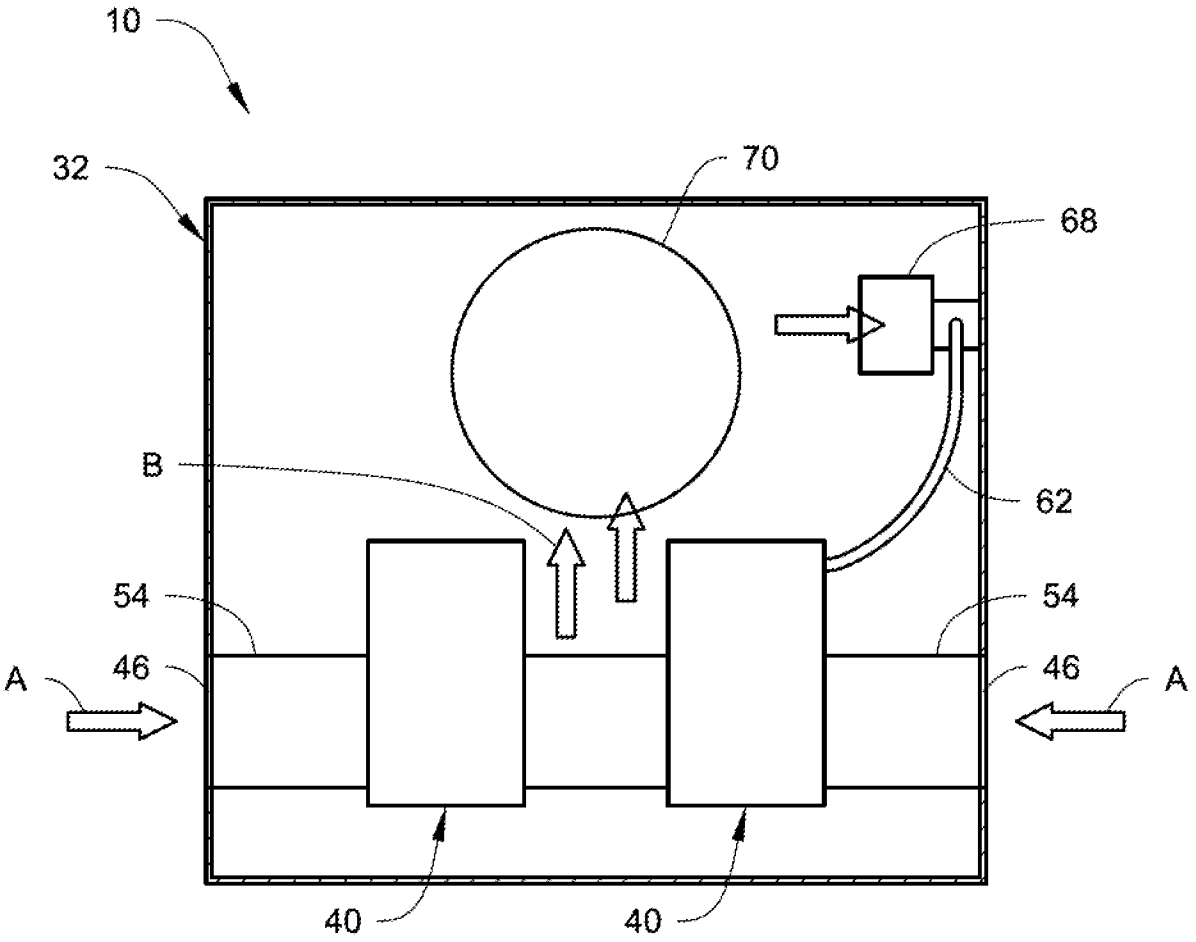
FIG. 10 depicts another embodiment with air intake from the interior space of the cabinet.

Returning to FIG. 2, the air compressor 40 further includes a head section 56 (or compressor head) that produces the compressed air. The construction and operation of a head section on a compressor is well known. The head section 56 includes an air intake 58 that receives air to be compressed and a compressed air exhaust 60 through which compressed air is discharged. In the illustrated example, the air intake 58 is fluidly connected to the ambient environment via an air intake conduit 62 whereby all of the air to be compressed is received from the ambient environment. FIG. 8 illustrates an example of the cabinet 32 as including a pair of air inlets 66 that are in fluid communication with respective ones of the air intake conduits 62 of separate compressors 40. In addition, the air exhaust 60 is fluidly connected to the exterior of the cabinet 32 via an exhaust conduit 64. The air supply line 18 can be fluidly connected to the exhaust conduit 64. FIG. 10 illustrates an example where the head section of the compressor 40 intakes air from the interior space of the cabinet 32 via an air intake 68

An exhaust fan 70 (best seen in FIGS. 4-6 and 9) is also mounted on the cabinet 32. The exhaust fan 70 vents the interior space 42 of the cabinet 32 to the ambient environment. The system 10 is configured such that during operation of the air compressor 40 in generating compressed air, a negative cabinet pressure is created in the interior space 42 of the cabinet 32 where the pressure $P_i$ in the interior space 42 of the cabinet 32 is less than ambient pressure $P_a$ ($P_i<P_a$). The negative cabinet pressure helps the fan(s) 48 to run more efficiently. In one embodiment, the pressure $P_i$ may be substantially equal to or less than the ambient pressure $P_a$ ($P_i \leq P_a$).

Figure 4:
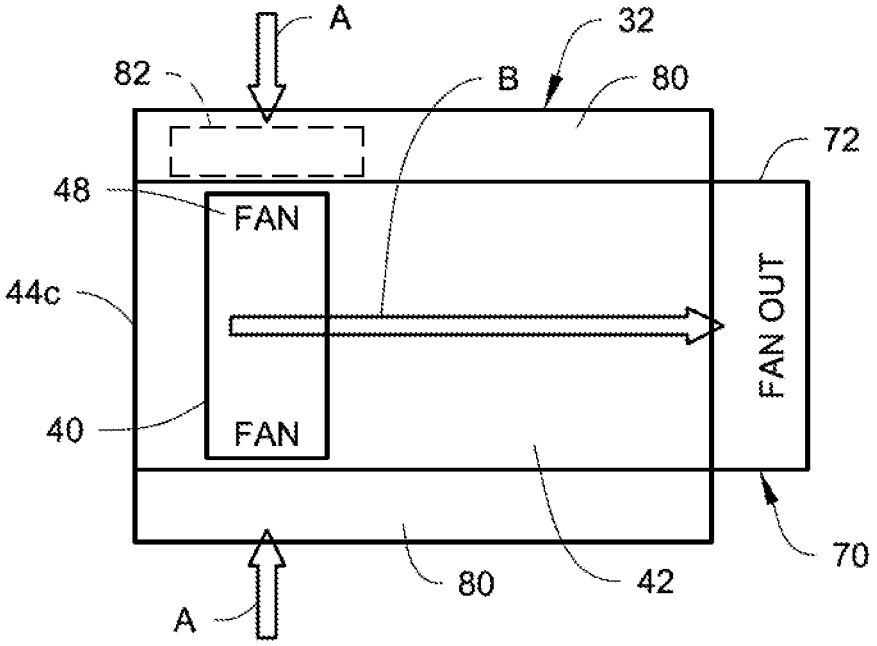
FIG. 4 is a top view of an embodiment of the cabinet with a single air compressor.
Figure 5:
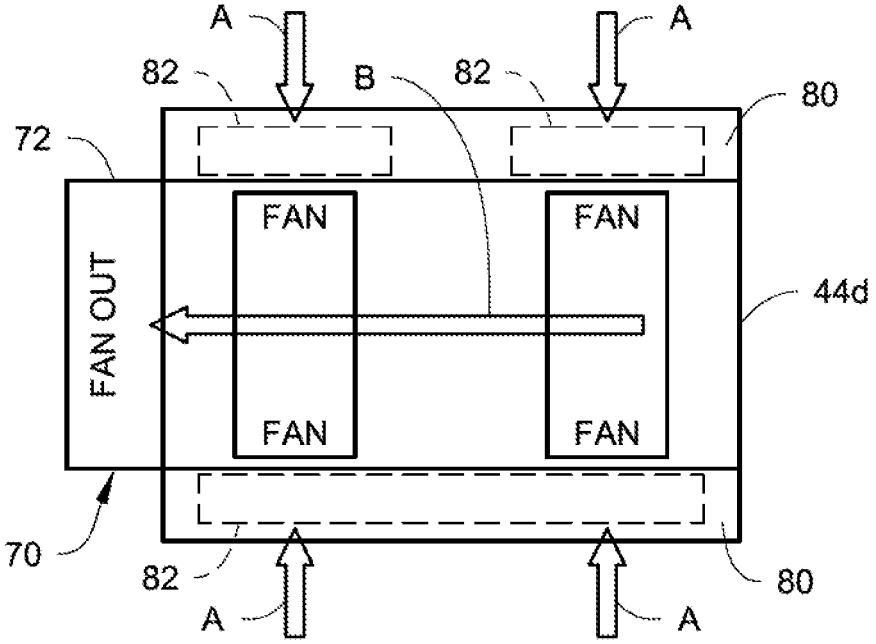
FIG. 5 is a top view of another embodiment of the cabinet with two air compressors.
Figure 6:
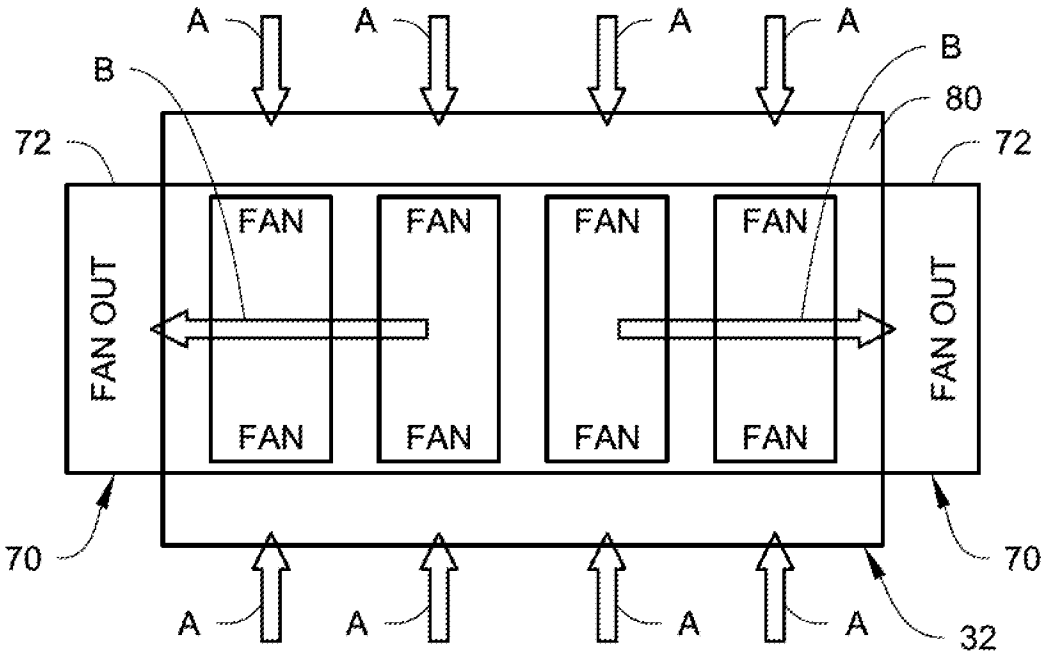
FIG. 6 is a top view of another embodiment of the cabinet with four air compressors.
Figure 9:
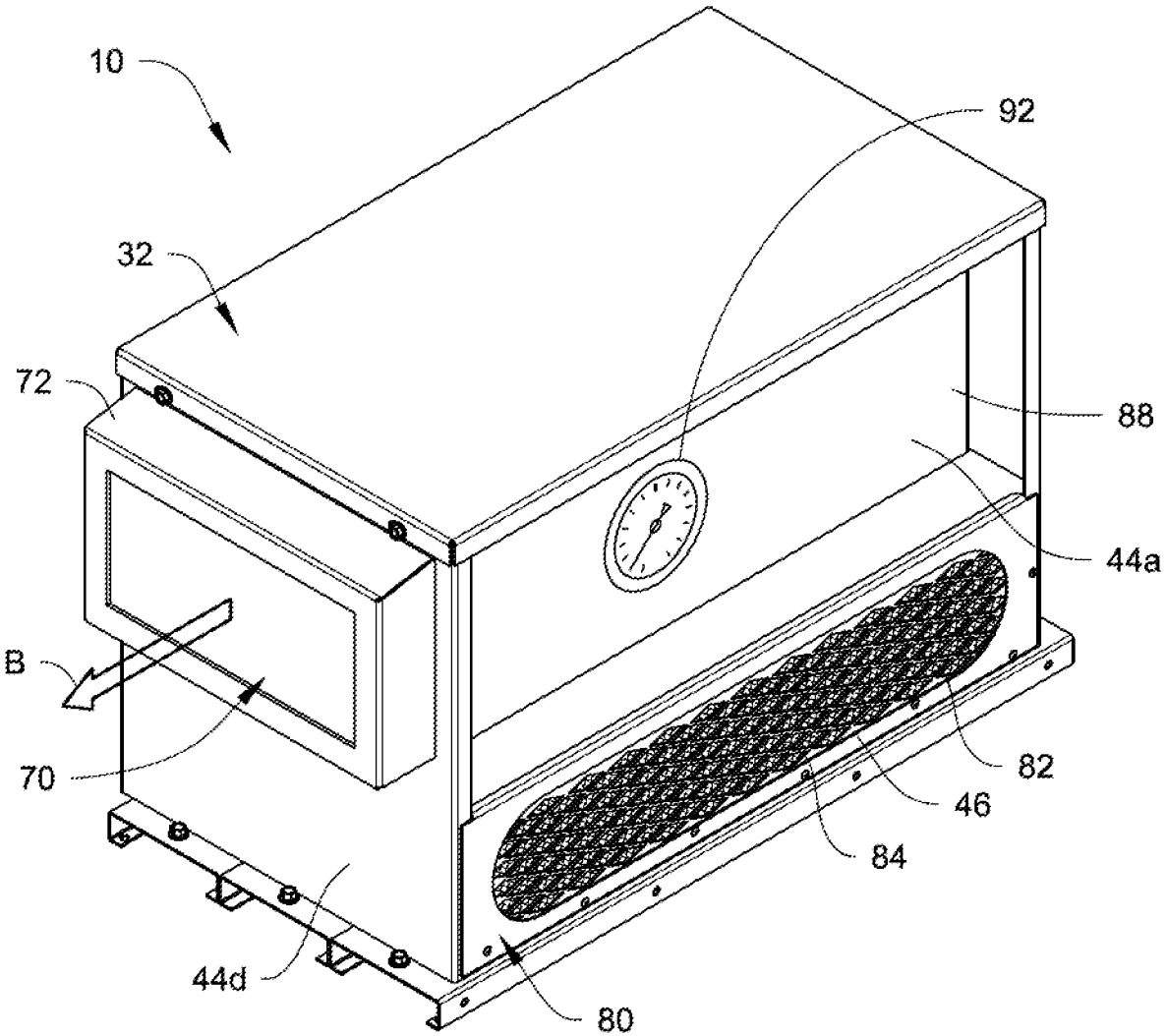
FIG. 9 is a perspective view of an embodiment of a cabinet depicting an example of an opposite side of the cabinet.

The exhaust fan 70 includes a fan cabinet 72 (see FIG. 9) mounted on any one of the walls 44*a-d*, 44*e*, 44*f* and that houses a fan (not visible) that is in communication with the interior space 42 to exhaust air from the interior space 42 to the ambient as indicated by the arrows B in FIGS. 4-6. A single exhaust fan 70 can be provided as illustrated in FIGS. 4-5 and 9, or multiple exhaust fans 70 can be provided as shown in FIG. 6. FIGS. 4-6 and 9 depict the exhaust fan(s) 70 as being mounted on the side walls 44*c*, 44*d*. However, the exhaust fan(s) 70 can be mounted on any one or more of the walls 44*a-f*.

Many variations are possible. For example, with reference to FIGS. 4-6, a single one of the compressors 40 (FIG. 4) can be mounted in the cabinet. In another embodiment, a pair of the compressors 40 (FIG. 5) can be mounted in the cabinet. In still another embodiment, four of the compressors 40 (FIG. 6) can be mounted in the cabinet. So the compressor system can include a single compressor 10 or two or more compressors 10.

In addition, with continued reference to FIGS. 4-6 and 9, the cooling air opening(s) in the cabinet wall(s) can be in communication with a cooling air plenum 80 on or more side walls of the cabinet 32. The cooling air inlets 50 (see FIG. 2) are then in direct fluid communication with and draw in cooling air from the plenums 80. One or more filters 82 may be disposed in the plenum(s) 80 for filtering the cooling air.

FIG. 9 illustrates an example of the cooling air opening 46 in the form of a single large opening leading to the plenum 80 with the filter 82 disposed in the plenum 80. In this example, a guard 84, such as a metal grate, can be provided in the opening 46 to prevent the intrusion of large objects such as sticks, leaves, rocks, etc. into the plenum 80. However, the guard 84 is optional as depicted in FIG. 8.

FIGS. 8 and 9 also depict the cabinet 32 as optionally including recessed areas 86, 88, respectively, on the side walls 44*b*, 44*a*. FIG. 8 depicts the air inlets 66 as being disposed in the recessed area 86. In addition, a plurality of compressed air outlets 90, each of which receives compressed air via the exhaust conduit(s) 64, are disposed in the recessed area 86. In one embodiment, a single one of the air inlets 66 and/or a single one of the air outlets 90 can be utilized. The recessed area 86 helps to protect the inlet(s) 66 and the outlet(s) 90. In FIG. 8, both the air inlets 66 and the compressed air outlets 90 are disposed on the same side of the cabinet, for example in the wall 44*b*, which differs from FIG. 2 which depicts the intake conduit 62 and the exhaust conduit 64 leading to opposite sides of the cabinet 32. FIG. 9 shows a pressure gauge 92 disposed in the recessed area 88. The pressure gauge 92 displays the pressure of the compressed air generated by the compressor 40. In the example in FIG. 9, a single pressure gauge 92 is illustrated corresponding to a single compressor in the cabinet 32. Additional ones of the pressure gauges 92 can be provided, one for each compressor in the cabinet 32.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. An air compressor system, comprising:

a cabinet having a plurality of walls defining an interior space, the plurality of walls includes a first side wall and a second side wall opposite the first side wall, the first side wall having a first cooling air opening that extends between the interior space and an ambient environment;

the second side wall has a second cooling air opening that extends between the interior space and the ambient environment;

at least one air compressor at least partially disposed within the interior space, the at least one air compressor includes a head section and a drive motor section, the head section having an air intake that receives air to be compressed and a compressed air exhaust through which compressed air is discharged;

the drive motor section includes a drive motor and a first cooling air inlet with a first fan at a first end of the drive motor for drawing first cooling air into the first cooling air inlet for cooling the drive motor;

the drive motor section includes a second cooling air inlet with a second fan at a second end of the drive motor for drawing second cooling air into the second cooling air inlet for cooling the drive motor;

the first cooling air inlet is directly fluidly connected to the first cooling air opening whereby the first cooling air for the drive motor is drawn into the first cooling air inlet from the ambient environment;

the second cooling air inlet is directly fluidly connected to the second cooling air opening whereby the second cooling air for the drive motor is drawn into the second cooling air inlet from the ambient environment;

an exhaust fan mounted on the cabinet and in communication with the interior space, the exhaust fan vents air that cooled the drive motor from the interior space of the cabinet to the ambient environment.

2. The air compressor system of claim 1, wherein during operation of the at least one air compressor, pressure in the interior space is less than ambient pressure.

3. The air compressor system of claim 1, wherein the first cooling air inlet abuts against the first side wall adjacent to the first cooling air opening whereby the first cooling air inlet is in direct physical engagement with the first side wall and the first cooling air for the drive motor is drawn into the first cooling air inlet through the first cooling air opening from the ambient environment; and the second cooling air inlet abuts against the second side wall adjacent to the second cooling air opening whereby the second cooling air inlet is in direct physical engagement with the second side wall and the second cooling air for the drive motor is drawn into the second cooling air inlet through the second cooling air opening from the ambient environment.

4. The air compressor system of claim 1, wherein a first fluid conduit extends between the first cooling air inlet and the first cooling air opening in the first side wall whereby the first cooling air for the drive motor is drawn into the first cooling air inlet from the ambient environment through the first fluid conduit; and wherein a second fluid conduit extends between the second cooling air inlet and the second cooling air opening in the second side wall whereby the second cooling air for the drive motor is drawn into the second cooling air inlet from the ambient environment through the second fluid conduit.

5. The air compressor system of claim 1, wherein the air intake of the head section is fluidly connected to the ambient environment whereby the air to be compressed is received from the ambient environment.

6. The air compressor system of claim 1, further comprising a first filter associated with the first cooling air opening and mounted on the first side wall, and a second filter associated with the second cooling air opening and mounted on the second side wall.

7. The air compressor system of claim 1, wherein the at least one air compressor is comprised of at least two air compressors at least partially disposed within the interior space.

8. An aeration system comprising: the air compressor system of claim 1; a diffuser fluidly connected to the compressed air exhaust and receiving the compressed air therefrom.

9. An air compressor system, comprising:

a cabinet having a plurality of walls defining an interior space, the plurality of walls includes a first side wall and a second side wall opposite the first side wall, the first side wall having a first cooling air opening extending therethrough in fluid communication with an ambient environment;

the second side wall has a second cooling air opening extending therethrough in fluid communication with the ambient environment;

at least one air compressor that includes a head section and a drive motor section, the head section is disposed entirely within the interior space, the head section having an air intake that receives air to be compressed and a compressed air exhaust through which compressed air is discharged;

the drive motor section includes a drive motor and a first cooling air inlet with a first fan at a first end of the drive motor for drawing first cooling air through the first cooling air opening and into the first cooling air inlet for cooling the drive motor, the drive motor section includes a second cooling air inlet with a second fan at a second end of the drive motor for drawing second cooling air through the second cooling air opening and into the second cooling air inlet for cooling the drive motor;

an exhaust fan mounted on the cabinet and in communication with the interior space, the exhaust fan vents air that cooled the drive motor from the interior space of the cabinet to the ambient environment;

wherein during operation of the at least one air compressor, the interior space of the cabinet has a negative pressure.

10. The air compressor system of claim 9, wherein the air intake of the head section is fluidly connected to the ambient environment whereby the air to be compressed is received from the ambient environment.

11. The air compressor system of claim 9, further comprising a first filter associated with the first cooling air opening and mounted on the first side wall, and a second filter associated with the second cooling air opening and mounted on the second side wall.

12. The air compressor system of claim 9, wherein the at least one air compressor is comprised of at least two air compressors at least partially within the interior space.

13. An aeration system comprising: the air compressor system of claim 9; a diffuser fluidly connected to the compressed air exhaust and receiving the compressed air therefrom.

14. An air compressor system, comprising:

a cabinet having a plurality of walls defining an interior space, the plurality of walls includes a first side wall, a second side wall, a top wall and a bottom wall, the first side wall having a cooling air opening extending therethrough in fluid communication with an ambient environment;

at least one air compressor at least partially disposed within the interior space, the at least one air compressor includes an air compression section and a drive motor section, the drive motor section includes a drive motor and at least one cooling air inlet with a fan for drawing cooling air into the at least one cooling air inlet for cooling the drive motor;

the at least one cooling air inlet is directly fluidly connected to the cooling air opening whereby the cooling air for the drive motor is drawn into the at least one cooling air inlet from the ambient environment;

an exhaust fan mounted on the second side wall outside of the interior space, the exhaust fan is and in communication with the interior space, the exhaust fan vents air that cooled the drive motor from the interior space of the cabinet to the ambient environment;

wherein during operation of the at least one air compressor, the interior space of the cabinet has a negative pressure.

15. The air compressor system of claim 14, further comprising a filter associated with the cooling air opening and mounted on the first side wall.

16. The air compressor system of claim 14, wherein the at least one air compressor is comprised of at least two air compressors at least partially disposed within the interior space.

17. An aeration system comprising:

the air compressor system of claim 15;

a diffuser fluidly connected to the air compression section and receiving compressed air therefrom.

18. The air compressor system of claim 14, wherein: the plurality of walls includes a third side wall located opposite the first side wall, the third side wall has a second cooling air opening extending therethrough in fluid communication with the ambient environment; the drive motor section includes a second cooling air inlet with a second fan for drawing cooling air into the second cooling air inlet for cooling the drive motor; the second cooling air inlet is directly fluidly connected to the second cooling air opening.

* * * * *